US006260886B1

(12) United States Patent
Hollingbery

(10) Patent No.: US 6,260,886 B1
(45) Date of Patent: Jul. 17, 2001

(54) DEVICE FOR DISPLAYING AND/OR TRANSPORTING AN ITEM

(75) Inventor: David P. Hollingbery, Palatine, IL (US)

(73) Assignee: Photo Fits, LLC, Palatine, IL (US)

( * ) Notice: Subject to any disclaimer, the term of this patent is extended or adjusted under 35 U.S.C. 154(b) by 0 days.

(21) Appl. No.: 09/448,813

(22) Filed: Nov. 24, 1999

Related U.S. Application Data

(60) Provisional application No. 60/109,933, filed on Nov. 25, 1998, and provisional application No. 60/164,177, filed on Nov. 9, 1999.

(51) Int. Cl.[7] ..... B42D 15/00

(52) U.S. Cl. ..... 283/101; 283/109; 283/75; 283/77; 40/626

(58) Field of Search ..... 283/74, 75, 76, 283/77, 78, 101, 107, 108, 109, 110, 111, 112; 40/299, 625, 626, 661; 428/142

(56) References Cited

U.S. PATENT DOCUMENTS

| | | | | |
|---|---|---|---|---|
| 3,896,726 | * | 7/1975 | Staats | 101/369 |
| 4,008,852 | | 2/1977 | Davis | 229/92.3 |
| 4,070,774 | * | 1/1978 | Staats et al. | 283/72 |
| 4,079,881 | | 3/1978 | Sabb | 229/92.8 |
| 4,183,554 | * | 1/1980 | Howard, Jr. | 283/77 X |
| 4,237,633 | | 12/1980 | Murrell | 40/158 R |
| 4,330,350 | * | 5/1982 | Andrews | 283/77 X |
| 4,662,093 | | 5/1987 | Suttles et al. | 40/158 R |
| 4,807,807 | | 2/1989 | Glick | 229/92.8 |
| 4,953,780 | | 9/1990 | Ross | 229/92.8 |
| 4,973,087 | | 11/1990 | Balogh | 283/62 |
| 5,005,874 | | 4/1991 | Matsuguchi et al. | 283/101 |
| 5,543,010 | * | 8/1996 | Keng | 283/77 X |
| 5,788,144 | | 8/1998 | Sorge et al. | 229/92.8 |

FOREIGN PATENT DOCUMENTS

| | | |
|---|---|---|
| 295 09 452 U1 | 11/1995 | (DE) . |
| 0 584 205 B1 | 5/1992 | (EP) . |
| WO 92/20528 | 11/1992 | (WO) . |

* cited by examiner

*Primary Examiner*—Willmon Fridie, Jr.

(57) ABSTRACT

This invention relates to a device for displaying and/or transporting an item, where the device comprises a transparent front that forms a sealable pocket with a substantially solid surface, such as a card.

19 Claims, 11 Drawing Sheets

A. Side View (Elevation A-A)

B. Top View of Transparent Membrane

A

B

A

B

4C

4D

A

B

DEVICE FOR DISPLAYING AND/OR TRANSPORTING AN ITEM

PRIOR APPLICATIONS

This application is a continuation-in-part of U.S. Prov. App. No. 60/109,933 filed Nov. 25, 1999 and U.S. Prov. App. No. 60/164,177 filed Nov. 9, 1999, each of which are hereby incorporated in their entirety into this application.

FIELD OF THE INVENTION

This invention relates to a device envelope with a transparent front and a substantially solid surface that together form a sealable pocket for insertion of an item to be displayed or transported.

BACKGROUND OF THE INVENTION

An envelope is used to protect and hide its contents during transit. The window envelope is an exception to this as it exposes a small area so that a name and address can be viewed. A postcard is a single piece of card that normally has space for writing a name, address and message on one side with a photographic print or similar on the other. Conventional postcards are produced in numbers and as a result can only offer impersonal scenes or graphics. The instant invention allows a person to send a photograph, personal or otherwise, in the postcard format. Others have attempted to provide such a device, as indicated below.

Matsuguchi, et al. (U.S. Pat. No. 5,005,874) disclose a postcard material bearing a label covering at least part of the postcard material. The label has a top material that is at least partly opaque, an inter-layer peel ply formed on the principal surface of the top material, a synthetic resin layer at least partly transparent formed on the principal surface of the inter-layer peel ply and an adhesive layer formed on the principal surface of the synthetic resin layer and which is transparent in the part corresponding to the transparent part of the synthetic resin layer. With this postcard the top material of the label can be peeled off the synthetic resin layer in the part where the interlayer peel ply is formed. Secret information shown on the principal surface of the postcard material is visible through the transparent synthetic resin layer when the top material is peeled off the synthetic resin layer. In contrast to the device of Matsuguchi, the instant invention does not require a peel ply. In addition, the postcard of Matsuguchi is not amenable to the safe and efficient mailing of an item such as a personal photograph, as is the instant invention.

Balogh et al. (U.S. Pat. No. 4,973,087) disclose a mailing card that is formed of a single sheet of card stock in which a perforated delineation extends entirely across the sheet of card stock to define first and second portions thereof and to facilitate complete separation of those portions from each other. An opening with at least one transparent window tinted in a fist color is defined in the first portion of the card stock. Matter is printed on the second portion of the card stock in both the color of the window and in at least one other contrasting color. By separating the first and second portions of the card stock, hidden messages printed on the second portion may be viewed through the window in the first portion that masks the matter printed in the same color as the window. The instant invention does not require various shades of tinting and is not designed for reading of hidden messages by viewing one portion of the card through a separated second portion of the card.

Glick (U.S. Pat. No. 4,807,807) provides a postcard formed from a sheet-form member, for example a card, which is provided with a first layer of adhesive. An additional transparent sheet is secured along one edge, preferably its upper edge, to the card and is provided with a second layer of adhesive. A protective sheet is located between the two layers of adhesive to keep them separate. In use, a photograph or other article can be secured and sandwiched between the sheet-form member and the transparent sheet. In contrast, the instant invention does not require that the article be adhered to the postcard.

Murrell (U.S. Pat. No. 4,237,633) provides a photograph mailing postcard having two flap portions is described. This postcard of Murrell requires an adhesive strip for attaching a photograph for viewing through the window in the bottom flap. Adhesive is also provided on the front side of one of the flap portions for adhering the two flap portions together following attachment of the photograph. In contrast, the instant invention does not require the use of an adhesive upon the display surface to hold the item, such as a photograph, in place.

Suttles et al. (U.S. Pat. No. 4,662,093) provide a device having first and second panels connected by a hinge joint for folding together. The front surface of the first panel is capable of receiving a design and the rear surface thereof has a paper release sheet covering a pressure sensitive adhesive which holds the photograph in place and also holds the card in folded condition. The front surface of the second panel is a support surface for a photograph and includes a small area of pressure sensitive adhesive for temporarily holding a photograph in place. The rear surface of the second panel comprises a message-address postcard surface. An opening cut through the first panel is arranged to display a photograph there through when the panels are folded shut and held shut by the adhesive on the rear surface of the first panel. In contrast, the instant invention does not require an adhesive upon the display surface to hold the item, such as a photograph, in place.

Davis (U.S. Pat. No. 4,008,852) provides a mailing card comprises first and second card sections which are foldable together. The first card section contains an adhesive surface for carrying an object such as a photograph. A removable backing sheet overlies the adhesive surface. The second card section has an opening situated for general alignment with the adhesive surface when the first and second card sections are in a folded condition. A transparent cover extends across the opening. In contrast, the instant invention does not require an adhesive upon the display surface to hold the item, such as a photograph, in place. In addition, the card material is not folded to seal the item upon the photograph.

Ross (U.S. Pat. No. 4,953,780) provides a postcard entirely covered on one side with adhesive and overlaid with a protective sheet. In contrast, the instant invention does not require an adhesive upon the display surface to hold the item, such as a photograph, in place.

Sabb (U.S. Pat. No. 4,079,881) provides a postcard including relatively rigid panel made of cardboard, or the like, having a writing surface on one side thereof and a photograph display surface on the other side thereof. The photograph display surface has a layer of adhesive thereon to which is secured a clear plastic sheet beneath which a photograph is secured. In contrast, the instant invention does not require that an item, such as a photograph, be adjoined to the card material using an adhesive.

Sorge et al. (U.S. Pat. No. 5,788,144) provide a combined picture frame and mailer formed of a single piece of reinforced paper folded along a horizontal axis into two substantially equal halves forming front and back panels. The front panel has a central cutout providing a window behind which the picture is placed and which is covered by a transparent sheet of cellophane. The back panel is provided with flaps about its remaining peripheral edges which fold over the corresponding edges of the front panel, and which are sealed to form a closed thin envelope. The back panel is also provided with fold out legs permitting the frame to stand alone on a flat surface such as a table as well as space in which the user may write a message as on a postcard. In contrast, the instant invention does not require the user to fold the card material to seal the item, such as a photograph, within the postcard. In addition, the user is not required to fold multiple flaps in order to seal the item within the card.

SUMMARY OF THE INVENTION

It is an object of the invention to provide a sealable device for displaying and/or transporting an item. In one embodiment, the present invention provides a device comprising a pocket made up of a transparent membrane or sheet partially affixed to a solid surface such that an optionally sealable pocket is formed. In a preferred embodiment, the device comprises a zippered score on the solid surface such that, following the sealing of the pocket, the contents can be removed by breaking the zippered score. In an exemplary embodiment, a device is shown that is suitable for enclosing a photograph. In another embodiment, the surface of the solid surface that is opposite the pocket comprises an area for writing, such that a type of postcard is provided.

In a preferred embodiment, the device comprises a card having an upper and a lower surface and a first, second, third and fourth edge; a transparent membrane having an upper and a lower surface where the upper and lower surface of the transparent membrane each further comprise a first, second, third and fourth edge; where the lower surface of the transparent membrane is positioned adjacent to the upper surface of the card; where the second, third and fourth edge of the transparent membrane and the card are affixed to one another, where the card comprises a sealing means on its first edge that is not affixed to the transparent membrane and wherein said sealing means can be optionally activated to substantially affix the first edge of the transparent membrane to the first edge of the card; wherein said lower surface of said card further comprises an area for writing; whereby a device having a sealable pocket for insertion of an item is provided.

The invention will be better understood and additional objects and advantages will become apparent from the following description and drawings.

DETAILED DESCRIPTION

Figure 1:
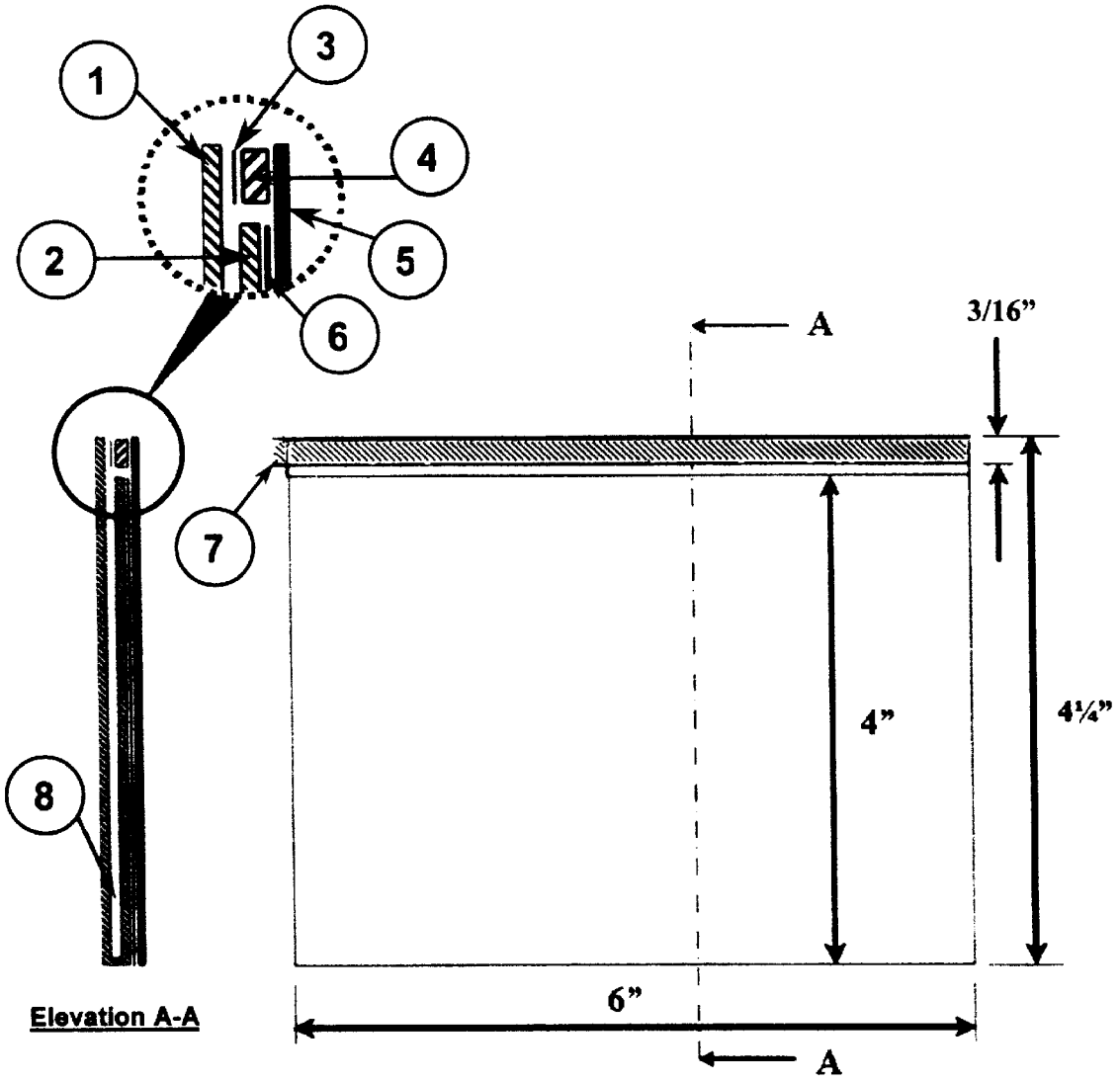
FIG. 1. A preferred embodiment of the device of the invention.

The present invention relates to a device for displaying and/or transporting an item. In one embodiment, the device provides a pocket into which can be inserted an item, such as a photograph. In a preferred embodiment, the pocket is sealable following insertion of the item into the pocket. In a most preferred embodiment, the device comprises a substantially solid surface upon which a second surface is partially attached to form a pocket between the two surfaces. In a preferred embodiment, the second surface is substantially clear such that the item contained in the pocket can be viewed. Exemplary items that could be inserted into the pocket may include a photograph or a coupon.

The device of the present invention comprises a card material having multiple edges. Preferably the card material comprises four edges, as is typically utilized in conventional postcards. However, it would be well within the means of a skilled artisan to produce a card similar to that described herein but having three, or five or more edges. The transparent membranes described herein could then accordingly comprise a number of edges different from four and preferably consistent with the number of edges on the card material itself.

Preferably, the card material is of a similar thickness and character as that of a typical index card. In one embodiment, the card material is #67 card stock. In a preferred embodiment, the card comprises a coating appropriate for acceptance of a polypropylene, PVC or other suitable transparent or opaque material (ie, the transparent membrane). In a more preferred embodiment, the card material is solid bleach sulphate base blister card stock. In a preferred embodiment, the card has four edges and an upper and a lower surface as typically utilized in a conventional postcard. In such an embodiment, the upper surface of the card is coated with a solvent base blister coating suitable for acceptance of a polypropylene, PVC or other suitable transparent or opaque material. In yet another embodiment, the transparent membrane can be formulated to accept print. One production method that can be used for producing a transparent membrane that can accept print is the corona process as is known in the industry.

In one embodiment, the card material is 4¾ inches high by 6½ inches wide. In another embodiment the card material is approximately 3½ inches high by 5 inches wide. However, any size card may be utilized that is suitable for mailing.

In one embodiment, the card material is from 0.005 to 0.08 inches thick, and in another embodiment is 0.009 inches to 0.02 inches thick. In a preferred embodiment, the card is 0.0165 inches thick. In one embodiment, the transparent membrane is typically 0.001 to 0.08 inches thick, and in another embodiment the membrane is 0.006 inches to 0.02 inches thick. In a preferred embodiment, the transparent membrane is 0.0075 inches thick.

This card material may further be of any light color that does not prevent legible addresses and postmarks from being placed on the card. Preferably, the card is white, light blue, light green, yellow, pink or tan/buff in color. In a preferred embodiment, the color is one that falls within the US postal regulations. However, any suitable color may be used to practice the instant invention.

In one embodiment, the postcard provides a pocket for enclosing an item such as a photograph for mailing. The postcard comprises a card material, such as 67 "pound" stock or similar material that is likely to have dimensions approximately equal or greater than 3½" width by 5" length that has an upper and a lower surface. A pocket is fixably attached to the postcard, the pocket being preferably formed by two layers of transparent membrane and one of a number of arrangements (see below) that can seal the mailing item (e.g. a photograph) within the aforementioned pocket during transit. The transparent membrane layers each have upper and lower surfaces and the upper and lower surfaces of the membranes further comprise a first, second, third and fourth edge. The two transparent membrane layers are sealed together along three of their four edges to form a pocket. Preferably the edges are heat-sealed. The fourth edge is preferably not sealed to allow the insertion of the item to be mailed. The lower surface of the transparent membrane pocket is attached to the upper surface of the said card by means of a suitable transparent adhesive such as, for example, transparent adhesive spray manufactured by 3M. The lower surface of the post card preferably contains an area for writing.

In another embodiment the postcard comprises a card material such as 67 "pound" stock or similar having dimensions approximately equal or greater than 3½" width by 5" length and having an upper and lower surface. In this embodiment, a transparent membrane having an upper and a lower surface where the upper and lower surface of the transparent membrane each further comprise a first, second, third and fourth edge is provided. Preferably the lower surface of the first, second and third edge of said transparent membrane are each partially but fixably attached by means of a suitable transparent adhesive such as, for example, a transparent adhesive spray manufactured by 3M to the upper surface of the card to form a pocket into which an item may be inserted. The lower surface of said card contains an area for writing. Thus a postcard having a sealable pocket for insertion of an item and a surface for including a message is provided.

In yet another embodiment, the postcard comprises a card material such as 67 "pound" stock or similar material that is likely to have dimensions approximately equal or greater than 3½" width by 5" length having an upper and a lower surface and a transparent membrane having an upper and lower surface. The upper and lower surfaces of the transparent membrane each further comprise a first, second, third and fourth edge. The transparent membrane is preferably of greater length and width than that of the said card. As a result, three of the four edges of the transparent membrane overlap the edges of the said card material. The three edges that overlap the said card are folded to allow the lower surface of the transparent layer to be fixed to the lower surface of the said card along its three corresponding edges by means of a suitable transparent adhesive such as, transparent adhesive spray manufactured by 3M. The lower surface of said card preferably comprises an area for writing. Accordingly, a postcard having a sealable pocket for insertion of an item and a surface for including a message is provided.

The postcard comprises sealing means for enclosing an item within the pocket. The sealing means may include but is not limited to the following embodiments. Many other suitable sealing means are known in the art and could be utilized by the skilled artisan in practising the instant invention.

In one embodiment, the sealing arrangement comprises an adhesive strip having an upper and lower surface; each of said surfaces comprising adhesive. The lower surface of the adhesive strip is fixed to the upper surface of the card adjacent to an edge of the card. The upper surface of the adhesive strip is covered with a piece of removable paper that is preferably longer in length than the edge to which it is fixed to allow for efficient removal. The length of the adhesive strip is preferably equal to or less than the edge to which it is fixed. When this arrangement is used within the first embodiment described above the upper layer of the transparent membrane pocket overlaps its lower layer and the overlap is located above the upper surface of the said removable paper that covers the adhesive strip. To seal the postcard, the paper is removed from the adhesive strip and the lower surface of the upper transparent membrane layer is fixed to the upper surface of the adhesive strip.

In another embodiment, the sealing arrangement may comprise an overlapping transparent membrane flap as an integral part of the upper transparent membrane layer of the above designs. The lower surface of the flap may comprise an adhesive strip having and upper and lower surface; each of said surfaces comprising adhesive. The adhesive strip may be fixed to the lower surface of the flap by its upper surface. A paper strip covers the lower surface of the double-sided adhesive strip. To seal the postcard after the mailing item has been inserted into the pocket the paper strip is removed from the lower surface of the adhesive strip to expose the adhesive. The flap is folded over and the lower surface of the adhesive strip is fixed to the lower surface of the card.

In another embodiment, the card comprises one or more zippered scored lines (a "zippered score") to provide a convenient method for inserting and removing the photograph from the pocket. The score may be placed anywhere on the card, but is preferably positioned in the top quadrant of the card, relative to the wide edge. In a most preferred embodiment, the score is placed 4¼ inches from one of the wide edges on the card. In this embodiment, the score allows for the easy insertion of, for example, a photograph as the score allows the card area above the zippered score to be folded back (see drawing below). In this embodiment, the score provides access to the plastic pocket on the upper surface of the card after the pocket has been sealed, such as to remove the photograph or other item. As such, it is preferred that the zippered score be positioned between the adhesive strip and the bottom edge of the card (ie, within the area of the pocket). To remove a photograph or other item contained within the pocket, the score is simply broken. In one embodiment, the scored line provides from 5 to 1000 tabs connecting the non-scored portion of the card to the scored portion of the card such that a removable portion is formed. In another embodiment, the score provides from 20 to 500 tabs. Any number of tabs may be included in the scored line such that the pocket remains secured until it is desired to access the pocket. An exemplary embodiment, comprising a pair of scored lines, a removable portion and several tabs is shown below:

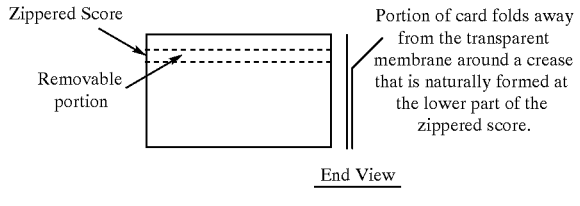

By opening the score and removing the removable portion, a channel is formed that provides access to the sealed pocket containing, for example, a photograph. The photograph may then be removed from the pocket.

In another embodiment, a card having an upper surface and a lower surface is cut to the preferred size and laminated on either the upper or lower surface. The postcard comprises a card material, such as 67 "pound" stock or similar material that is likely to have dimensions approximately equal or greater than 3½" width by 5" length that has an upper surface, a lower surface, and a first, second, third and fourth edge. In a preferred embodiment, the upper surface is laminated. A transparent membrane cut to approximately the same size as the laminated surface of the card is then aligned with the laminated surface of the card. The transparent membrane is then sealed along three of the edges of the card to form a pocket. Preferably, the three edges of the membrane are sealed to the laminated card using heat. The fourth edge is preferably not sealed to allow the insertion of an item such as a photograph. In a most preferred embodiment, the fourth unsealed edge further comprises an adhesive strip as described above. It is further preferred that the card comprises one or more scored lines as described above.

In one embodiment, the four corners of the card have a ⅛ inch radius cut. In a preferred embodiment, the cut is made using a die. The cut can be made prior to or following attachment of the plastic membrane to the card. In a preferred embodiment, the plastic membrane, the four corners of which are cut to a ⅛ inch radius, is placed on top of the card and heated along the edges to fix the membrane to the card. In an alternative embodiment, the plastic membrane is affixed to the card and the edges are then cut to a ⅛ inch radius. Preferably, the membrane is affixed along three edges, leaving one edge unattached wherein the item to be contained within the pocket may be inserted.

Yet another embodiment of a sealing arrangement features the use of an arrangement known as a Ziploc® (DowBrands L. P.) The design of the transparent membrane pocket and the transparent membranes mentioned in the above embodiments can be varied allowing the unsealed edge to be located above either of the cards four edges.

One method of manufacture is to coat the upper surface of the card with solvent base blister coating for acceptance of polypropylene, PVC, or other suitable transparent or opaque material. The adhesive strip is then fixed to the card. The cards are loaded into a machine and the machine takes one card and deposits a piece of transparent membrane on top of the card and then heat seals the three edges of the transparent membrane to the upper surface of the card with its solvent based blister coating to form a pocket. Any excess material is removed and the process is completed. This method overcomes the problems of exact alignment of two separate pieces.

It should be apparent to the skilled artisan that any of the configurations described herein may comprise the laminated card. In addition, the embodiments mentioned above that have a single transparent membrane design may be sealed in a similar fashion when using the aforementioned embodiment of the sealing arrangement.

Figure 7:
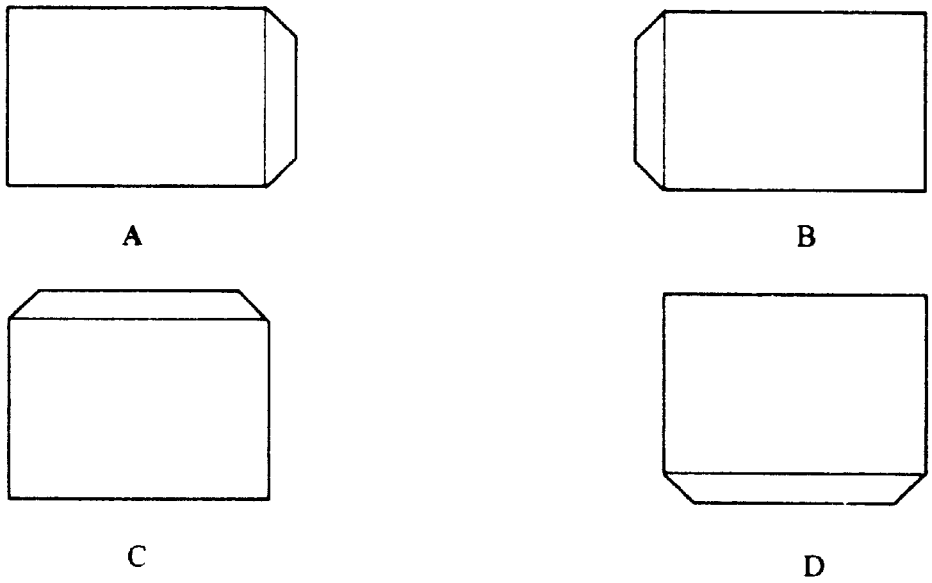
FIG. 7. Drawings 2*a* to 2*d* show the possible positioning of the fold over sealing tab.

FIG. 1 illustrates a preferred embodiment of the present invention. The drawing in FIG. 7 shows a piece of card 6 inches wide by 4¼ inches high and 0.0156" thickness upon which lies a layer of 3M transparent adhesive. A pocket formed from 2 layers of transparent membrane lies above the adhesive layer. The upper layer of the transparent pocket is 6 inches wide by 4¼ inches high and 0.00125" thickness.

The lower layer of the transparent pocket is 6 inches wide by 4 inches high and has 0.00125" thickness. The pocket is formed by fixing 3 of the 4 edges of the 2 layers of membrane together. In this case the 3 edges have been bonded together using heat. This was carried out using a "Seal a Meal" bag-sealing device used in the catering industry. The upper layer of the transparent membrane pocket is slightly larger than the lower layer and the excess transparent membrane lies above a strip of double-sided adhesive that is fixed at its lower surface to the said card. The upper surface of the double-sided adhesive tape is covered by a removable piece of paper that is of the same width but has greater length than the double-sided adhesive. The excess length of paper allows eazy removal for sealing the item to be mailed in the pocket. When sealing of the alternative postcard is required the strip of paper is peeled off to expose the upper adhesive surface of the double-sided adhesive tape. The lower surface of the upper layer of transparent membrane is then secured to this adhesive strip.

Figure 2:
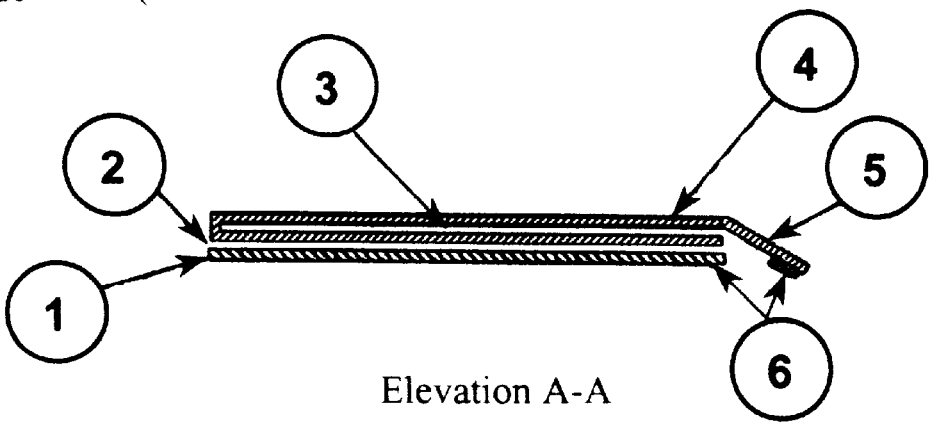
FIG. 2. Another embodiment with an alternative sealing arrangement.
Figure 2:
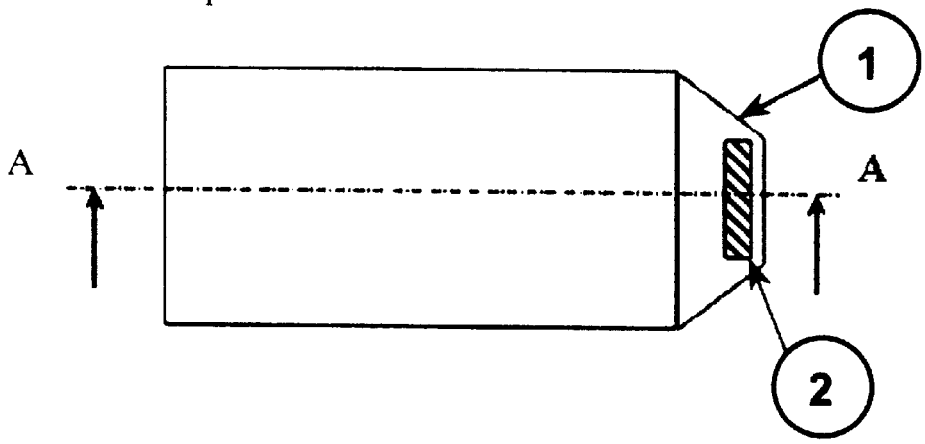

FIG. 2 illustrates another embodiment of the present invention. The drawing in FIG. 2 shows a piece of card upon which lies a layer of adhesive. A pocket formed from a transparent membrane that lies above the adhesive layer. The flap protrudes from the upper layer of the transparent pocket. On the underside of the flap is an area of covered adhesive. This adhesive would be uncovered to seal the pocket with its contents.

Figure 3:
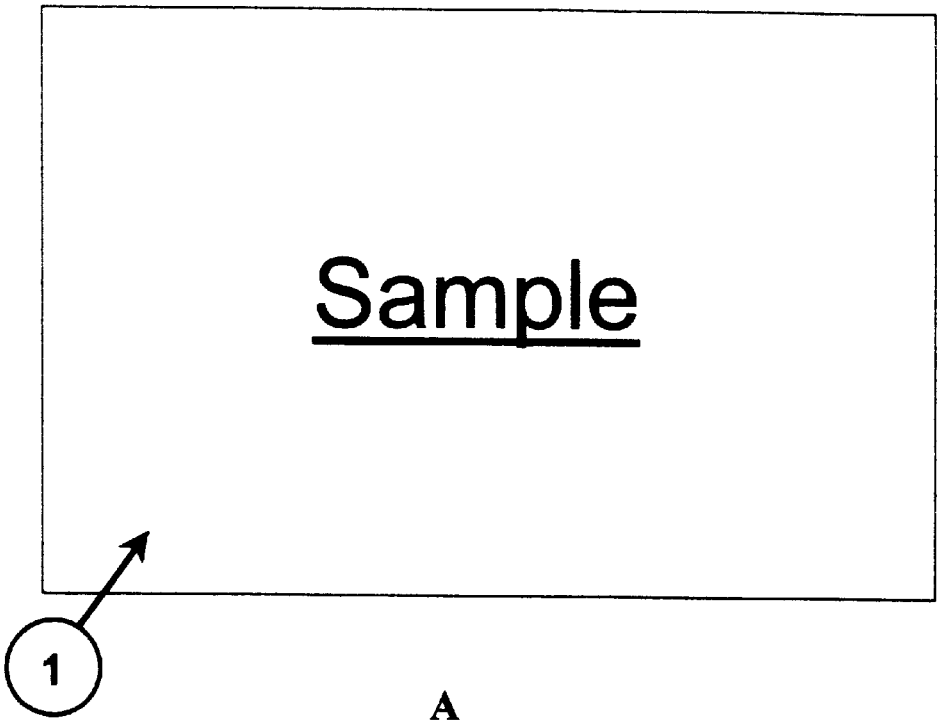
FIG. 3. Construction of a device of the invention: Method No.1.
Figure 3:
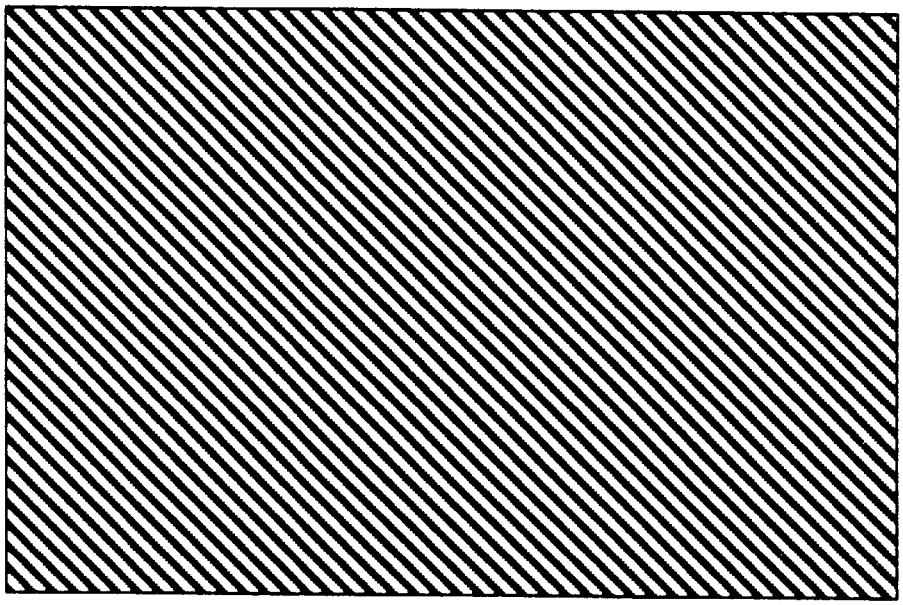
Figure 3C:
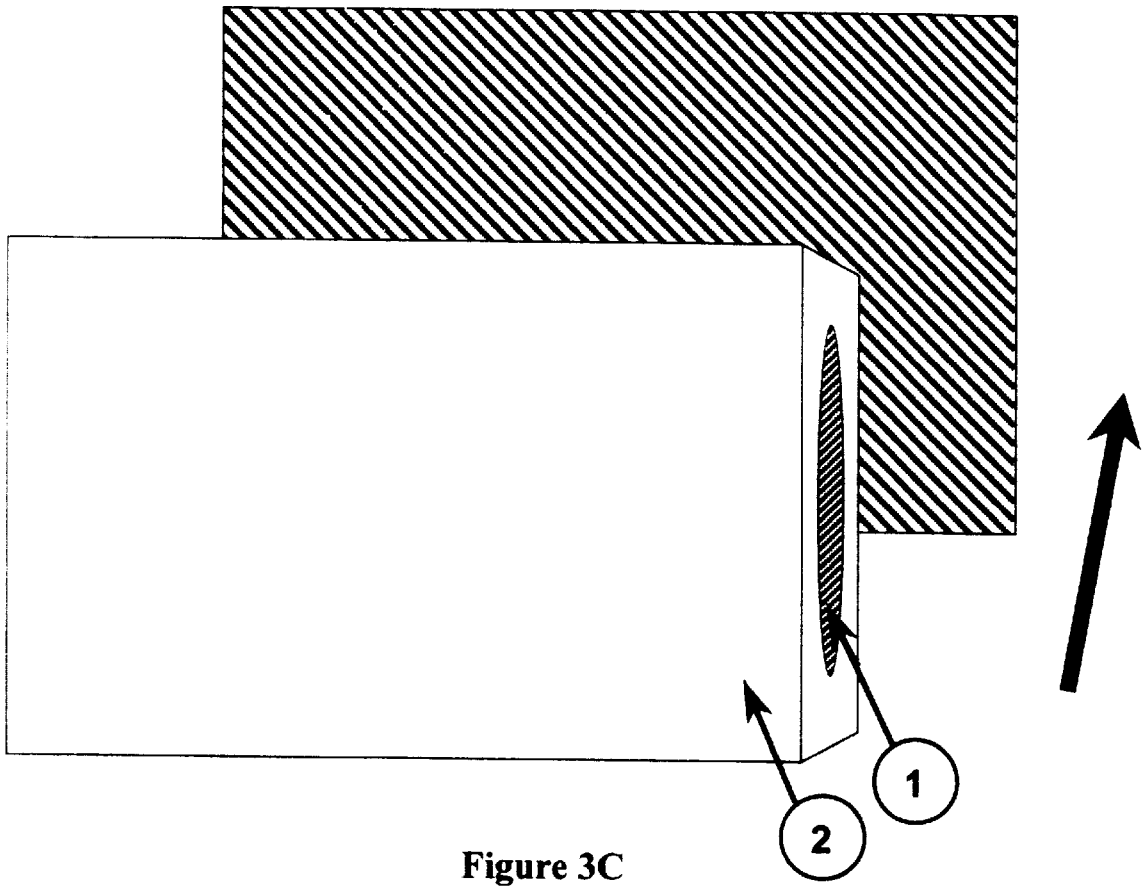
Figure 3D:
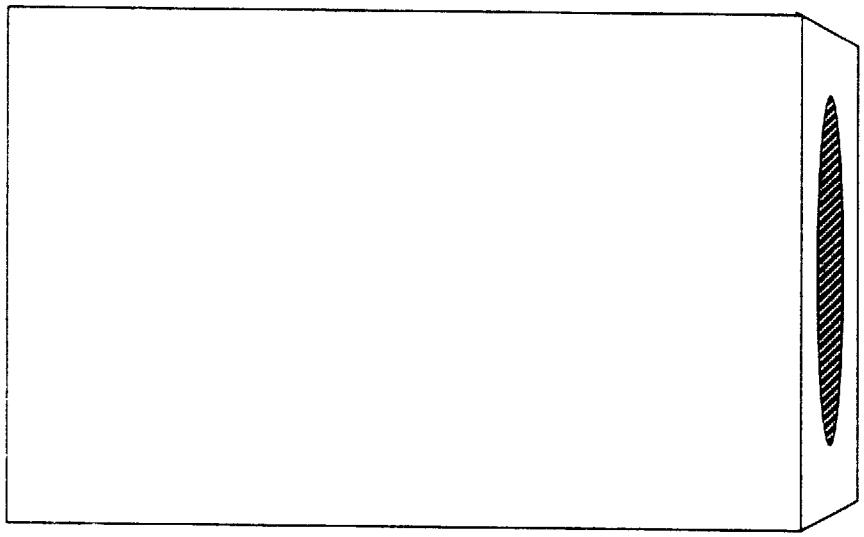

FIG. 3 illustrates another preferred embodiment of the present invention. This figure illustrates the manner in which the present invention is constructed. For the purpose of clarity we have featured the embodiment that uses the fold over flap sealing arrangement in this and the following illustrations as this is more visible than the sealing method used in FIG. 1. The illustrations show a card having a transparent sleeve attached to one side of that card by means of a transparent or virtually transparent adhesive. This transparent sleeve also has a transparent tab that extends over the end of the card. This tab can fold over to seal in the contents of the sleeve by sticking to the card.

Figure 4:
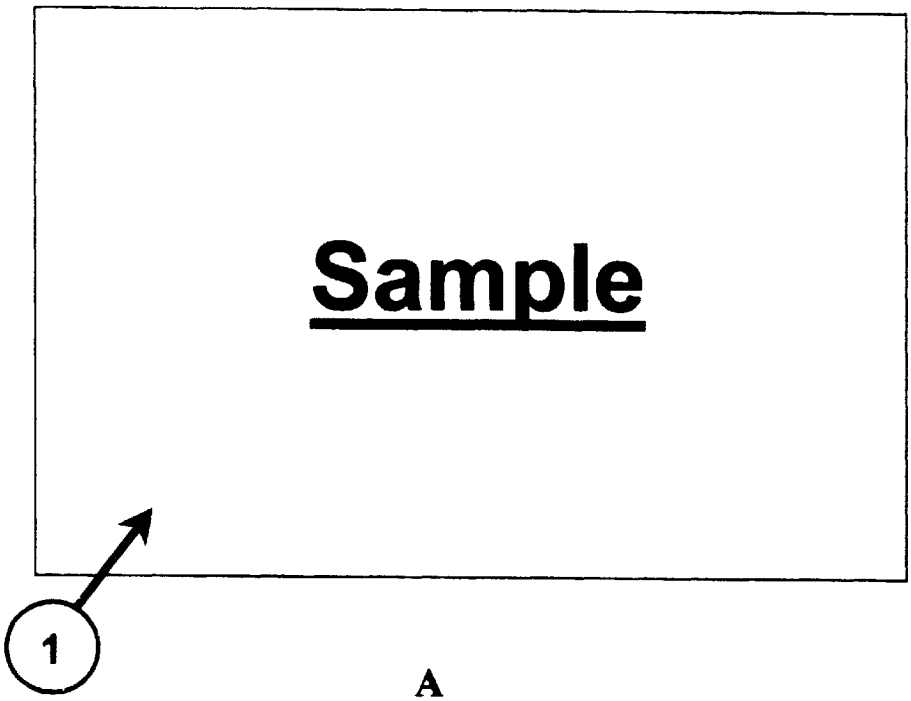
FIG. 4. Construction of a device of the invention: Method No. 2.
Figure 4:
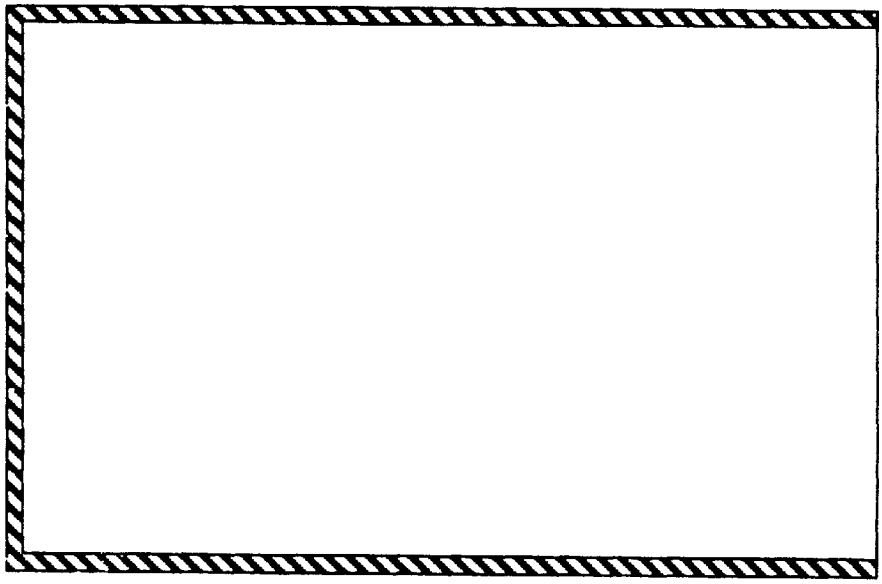
Figure 4:
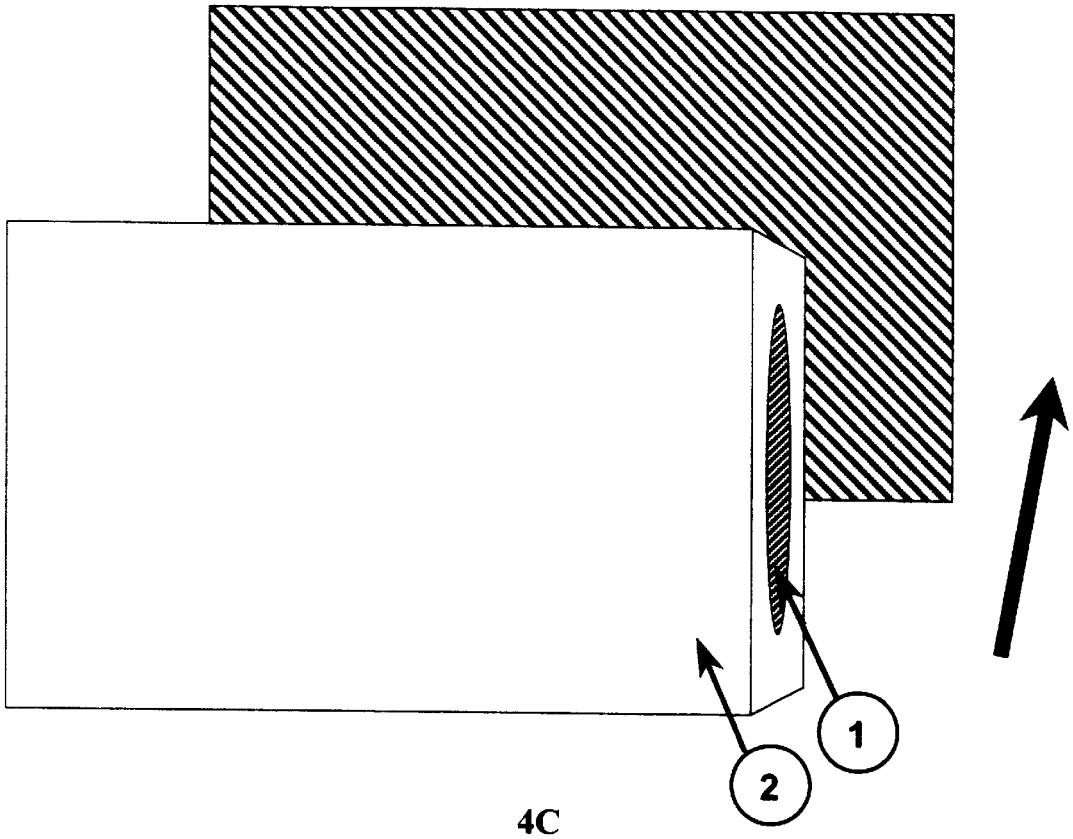
Figure 4:
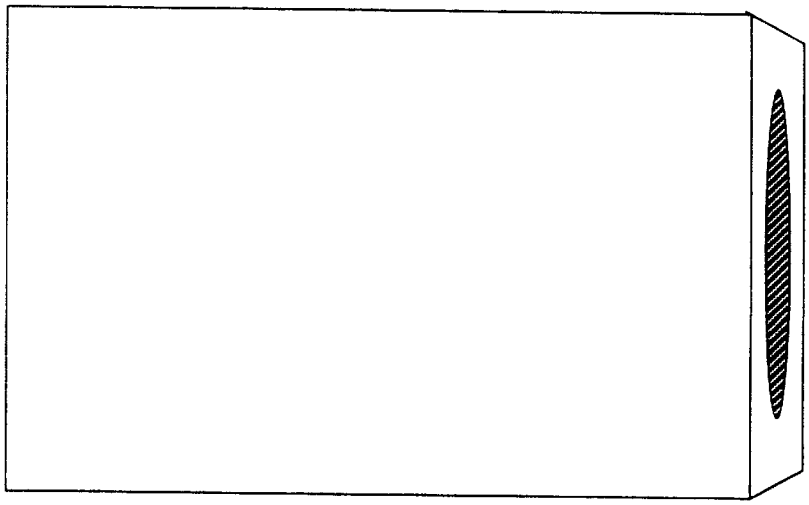

FIG. 4 illustrates yet another embodiment of the present invention. A single sheet of transparent material is fixed at the edges to one side of the card using transparent or virtually transparent adhesive. This sheet also has a transparent tab that extends over the end of the card. This tab can fold over to seal in the contents of the sleeve by sticking to the card.

Figure 5:
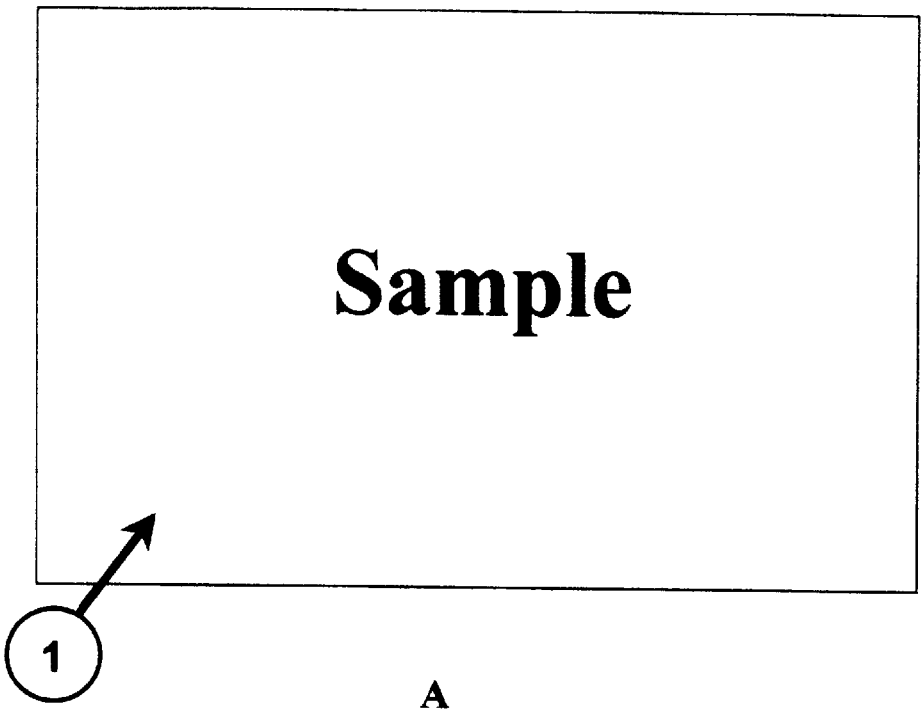
FIG. 5. Construction of a device of the invention: Method No. 3
Figure 5:
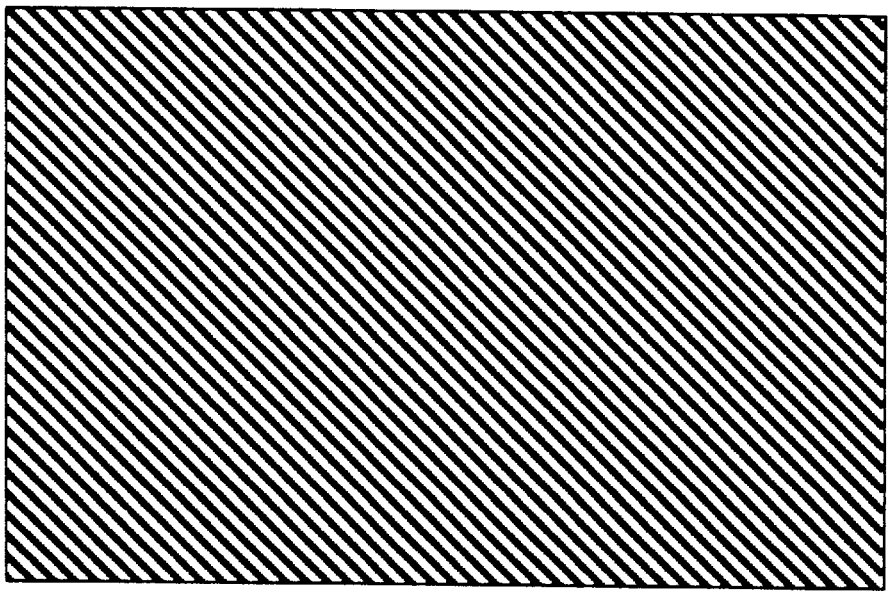
Figure 5C:
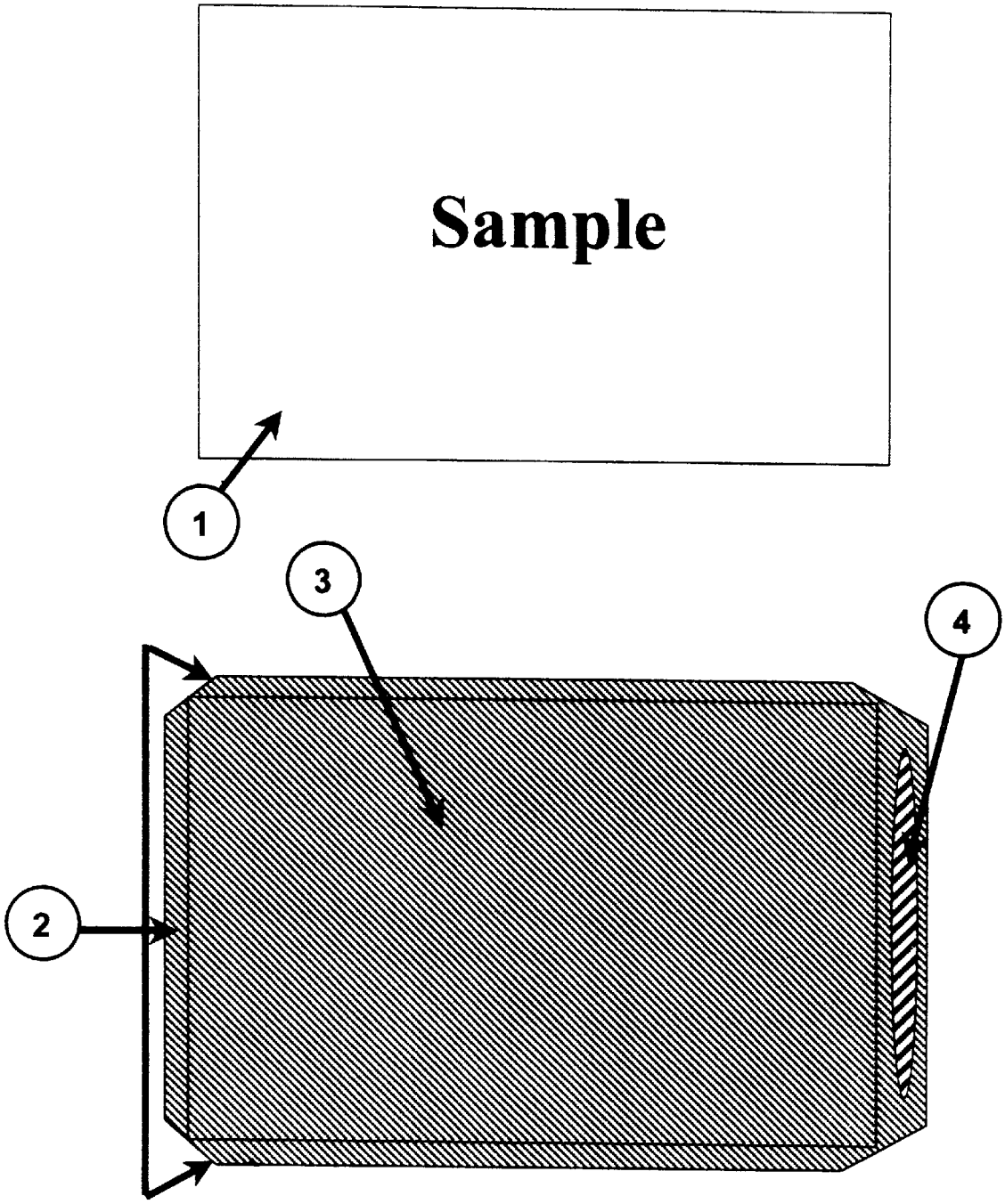
Figure 5D:
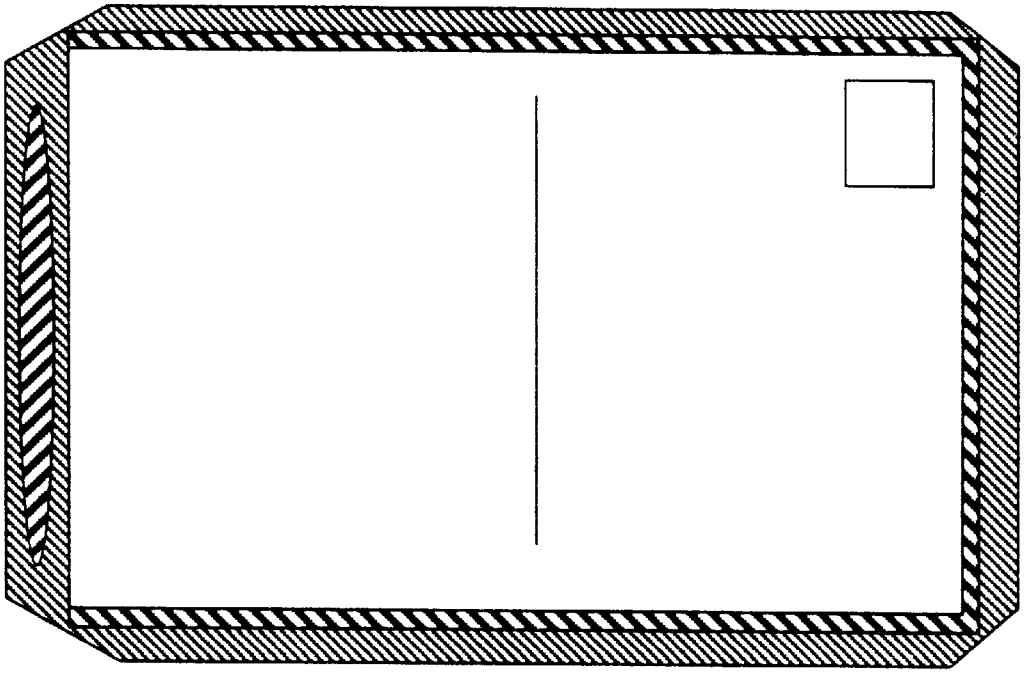

FIG. 5 illustrates another embodiment of the present invention. A single sheet of transparent material is placed over a piece of card. The transparent sheet is slightly larger than the card (as shown) and the excess material is folded over the edges of the card and fixed using adhesive on the other side of the card.

Figure 6:
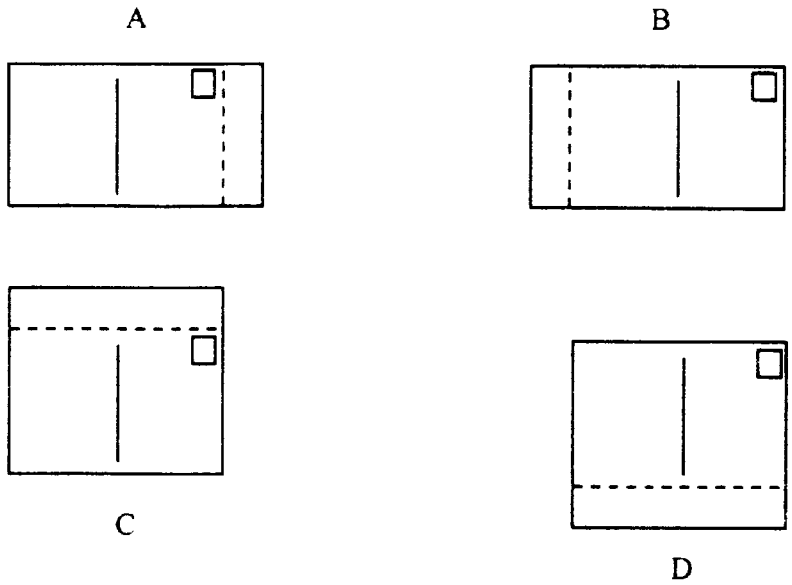
FIG. 6. Alternative Positions of Tear off Strips on the device of the invention.

FIG. 6 illustrates the position of an optional tear off strip. These strips could be of any size from any of the cards edges and can be used for various purposes (see drawings 1*a,* 1*b,* 1*c* and 1*d*). The tear off portion would be part of the original piece of card but the removal of this section would be facilitated by a perforation along a portion of the card.

FIG. 7 illustrates the possible positions of the transparent fold over flaps and the other alternative sealing arrangements mentioned in the above designs. The sealing arrangement can be adjacent to any of the four edges of the card. (See drawings 2*a,* 2*b,* 2*c* and 2*d*).

Figure 8:
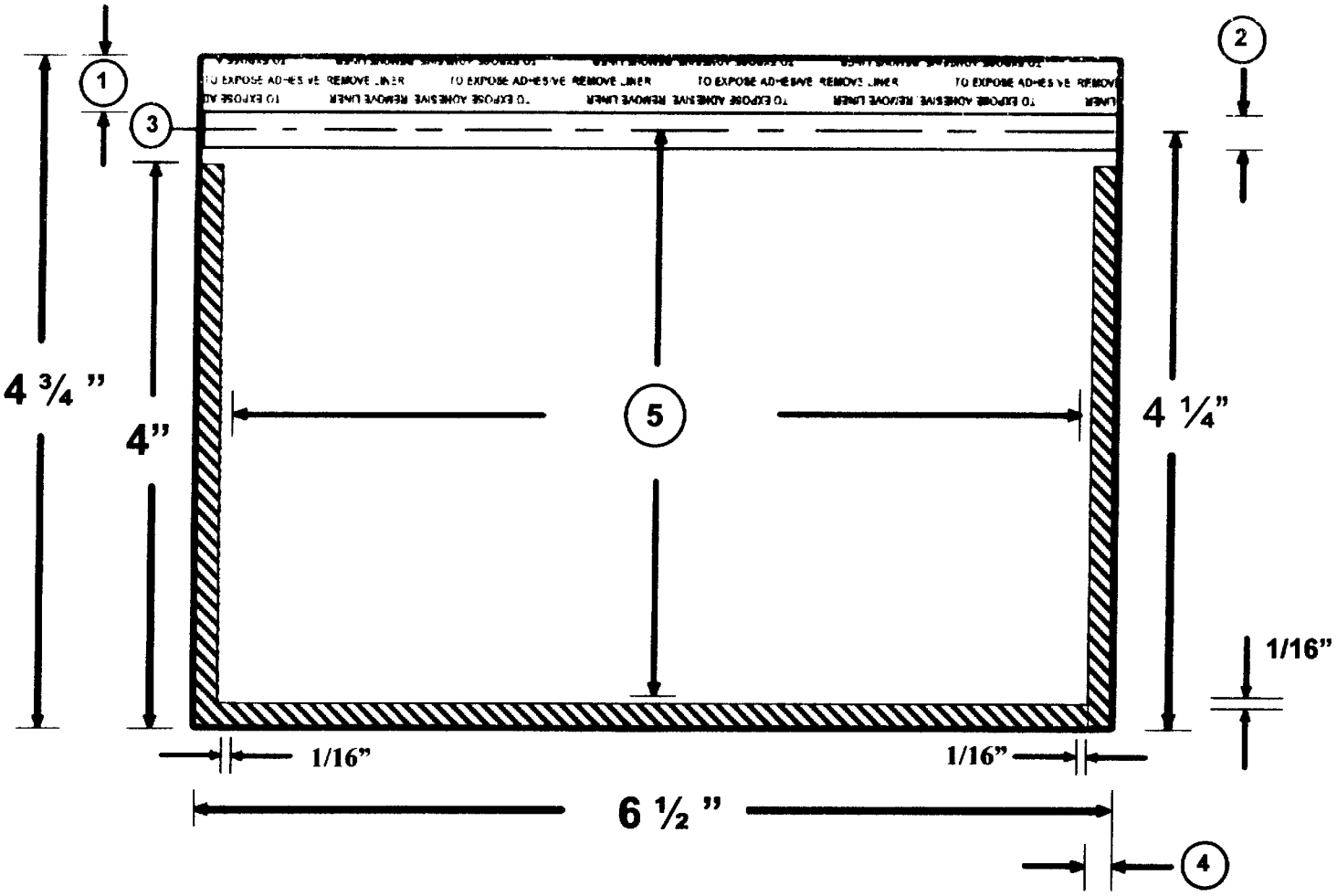
FIG. 8. A preferred embodiment, illustrating the Photo-fits® device.

A most preferred embodiment of the device, the Photofits® device, is shown in FIG. 8. In this particular embodiment, a 4¾ inch by 6½ inch card is attached along three edges to a transparent membrane. An adhesive strip is affixed along the non-attached edge, said adhesive strip being activated by removal of a protective paper strip covering the adhesive material. In addition, the preferred embodiment shown in FIG. 8 comprises a zippered score having a ¼ inch width. Following insertion of an item into the pocket formed between the upper surface of the card and the lower surface of the sheet and sealing of the pocket via the adhesive strip, the zippered score may be separated such that the item can be removed from the pocket. FIG. 8 refers to a photograph that can be inserted into the pocket. However, it should be understood that any suitable item may be inserted into the pocket. In addition, other features of this preferred embodiment can be inferred from the drawing in FIG. 8 by one of skill in the art.

It is to be understood that the forms of the invention shown and described herein are preferred examples and that various changes in the size, shape and arrangement may be made without departing from the spirit of the invention.

What is claimed is:

1. A device comprising:

a card having an upper and a lower surface and a first, second, third and fourth edge;

a first and second layer of transparent membrane each having an upper and a lower surface;

where the upper and lower surface of each transparent membrane each further comprise a first, second, third and fourth edge joined to one another at three of said edges to form a pocket into which an item may be inserted;

where the lower layer of the transparent membrane is of smaller dimension than the upper layer;

where the lower surface of the lower layer of transparent membrane is fixably attached to the upper surface of said card by adhesive;

where an adhesive strip having an upper and lower surface, each of said surfaces comprising adhesive is positioned at one edge of the card between the upper surface of the said card and the lower surface of the overlapping upper layer of transparent membrane;

where the lower surface of the adhesive strip is fixed to either the upper surface of the said card or to the lower surface of the upper layer of transparent membrane;

where the upper surface of the adhesive strip is covered with a removable strip of paper that is removed to expose the adhesive for sealing the upper transparent layer lower surface and the upper surface of said card together;

wherein said lower surface of said card comprises an area for writing.

2. A device of claim 1 where the upper and lower surface of each transparent membrane are joined to one another at three of said edges to form a pocket by heat bonding.

3. A device comprising:

a card having an upper and a lower surface and a first, second, third and fourth edge;

a first and second layer of transparent membrane each having an upper and a lower surface;

where the upper and lower surface of each transparent membrane each further comprise a first, second, third and fourth edge that are joined to one another at three of said edges to form a pocket into which an item may be inserted;

where the upper layer of transparent membrane further comprises a flap and a portion of the lower surface of the first edge of the upper layer of transparent membrane comprises an adhesive material;

where the lower surface of the lower layer of transparent membrane is fixably attached to the upper surface of said card by adhesive;

wherein said lower surface of said card contains an area for writing.

4. A device of claim 3 where the upper and lower surface of each transparent membrane are joined to one another at three of said edges to form a pocket by heat bonding.

5. A device comprising:

a card having an upper and a lower surface and a first, second, third and fourth edge;

a transparent membrane having an upper and a lower surface where the upper and lower surface of the transparent membrane each further comprise a first, second, third and fourth edge;

where the card comprises a sealing means;

where the lower surface of the second, third and fourth edge of said transparent membrane are each partially but fixably attached to the upper surface of said card to form a pocket into which an item may be inserted;

wherein said lower surface of said card contains an area for writing.

6. A device comprising:

a card having an upper and a lower surface and a first, second, third and fourth edge;

a transparent membrane having an upper and a lower surface where the upper and lower surface of the transparent membrane each further comprise a first, second, third and fourth edge;

where three of the four edges of the transparent membrane layer further comprise a flap;

where the lower surface of the transparent membrane is positioned adjacent to the upper surface of the card;

where the lower surface of each of the overlapping transparent membrane flaps are partially but fixably attached to the lower surface of said card by adhesive to form a pocket into which an item may be inserted;

where the card comprises a sealing means on its fourth edge;

wherein said lower surface of said card contains an area for writing.

7. A device comprising:

a card having an upper and a lower surface and a first, second, third and fourth edge;

a transparent membrane having an upper and a lower surface where the upper and lower surface of the transparent membrane each further comprise a first, second, third and fourth edge;

where the lower surface of the transparent membrane is positioned adjacent to the upper surface of the card;

where the second, third and fourth edge of the transparent membrane and the second third and fourth edge of the card are respectively affixed to one another to form a pocket;

where the card comprises a sealing means on its first edge that can be optionally activated to substantially affix the first edge of the transparent membrane to the first edge of the card;

wherein said lower surface of said card further comprises an area suitable for writing.

8. A device of claim 7 wherein said sealing means comprises an adhesive strip.

9. A device of claim 7 as illustrated in FIG. 8.

10. A device of claim 7 further comprising a zippered score within the card.

11. A device of claim 5 further comprising a zippered score within the card.

12. A device of claim 6 further comprising a zippered score within the card.

13. A device of claim 10 wherein said sealing means comprises an adhesive strip having affixed to it a protective paper strip, where removal of the paper strip exposes the adhesive material.

14. A device of claim 11 wherein said sealing means comprises an adhesive strip having affixed to it a protective paper strip, where removal of the paper strip exposes the adhesive material.

15. A device of claim 12 wherein said sealing means comprises an adhesive strip having affixed to it a protective paper strip, where removal of the paper strip exposes the adhesive material.

16. A device comprising:

a card having an upper and a lower surface, multiple edges and a zippered score;

a transparent membrane having an upper and a lower surface and multiple edges, one or more edges of the transparent membrane being affixed to one or more edges of the card;

where the card comprises a sealing means that is optionally activated to affix at least one edge of the transparent membrane to at least one edge of the card;

wherein said lower surface of said card further comprises an area for writing.

17. A device of claim 16 wherein said card and said transparent membrane each comprise four edges.

18. A device of claim 16 wherein said sealing means comprises an adhesive strip having affixed to it a protective paper strip, where removal of the paper strip exposes the adhesive material.

19. A device of claim 17 wherein said sealing means comprises an adhesive strip having affixed to it a protective paper strip, where removal of the paper strip exposes the adhesive material.

* * * * *